United States Patent [19]

Sakamoto et al.

[11] Patent Number: 4,566,420

[45] Date of Patent: Jan. 28, 1986

[54] ELECTRONIC CONTROL APPARATUS FOR INTERNAL COMBUSTION ENGINE

[75] Inventors: Masahide Sakamoto, Katsuta; Masami Shida, Mito, both of Japan

[73] Assignee: Hitachi, Ltd., Tokyo, Japan

[21] Appl. No.: 695,246

[22] Filed: Jan. 28, 1985

[30] Foreign Application Priority Data

Jan. 27, 1984 [JP] Japan ..... 59-11822

[51] Int. Cl.[4] ..... F02M 7/00; F02M 51/00

[52] U.S. Cl. ..... 123/489; 123/440; 123/480; 123/486

[58] Field of Search ..... 123/489, 440, 480, 486, 123/488, 487, 478, 491

[56] References Cited

U.S. PATENT DOCUMENTS

| | | | |
|---|---|---|---|
| 4,235,204 | 11/1980 | Rice | 123/440 |
| 4,495,925 | 1/1985 | Hasegawa | 123/489 |
| 4,497,301 | 2/1985 | Inoue et al. | 123/486 |
| 4,498,445 | 2/1985 | Hasegawa et al. | 123/489 |
| 4,502,443 | 3/1985 | Hasegawa et al. | 123/489 |
| 4,508,075 | 4/1985 | Takao et al. | 123/489 |
| 4,509,489 | 4/1985 | Hasegawa et al. | 123/489 |

*Primary Examiner*—Raymond A. Nelli
*Attorney, Agent, or Firm*—Antonelli, Terry & Wands

[57] ABSTRACT

A control apparatus for an internal combustion engine is arranged such that, for each of the operating condition sections (A, B, C) of an internal combustion engine (1), a deviation ($K_l$) of a feedback control value in the section from a reference value is detected and written in a region in a memory corresponding to the section in the form of a map, and the deviation ($K_l$) is read out such as to be used as a correction value when control is effected in relation to the corresponding operating condition section. In such control apparatus, whether or not the number of regions in the memory into which deviation values for operating condition sections ($T_p$, N) have already been written has reached a predetermined value is examined. When the number has reached the predetermined value, a deviation value is written into each of the regions in the memory into which no deviation values have yet been written, this deviation value already being stored in the adjacent region in the memory in which writing of deviation data has already been completed, whereby the feedback control delay can be eliminated.

2 Claims, 8 Drawing Figures

FIG. 4

| ENGINE SPEED N / Tp | 0 | 800 | 1200 | 1600 | 2000 | 2400 | 2800 | 3200 |
|---|---|---|---|---|---|---|---|---|
| 0 | (0) 0 | (1) −0.1 | (2) 0 | (3) 0 | (4) " | (5) " | (6) " | (7) 0 |
| 1.5 | (8) 0 | (A) +0.1 | 0 | −0.1 | 0 | " | " | 0 |
| 2.0 | (16) 0 | 0 | (B) 0 | (C) +0.1 | 0 | " | " | 0 |
| 2.5 | (24) 0 | −0.1 | 0 | +0.1 | 0 | " | −0.1 | 0 |
| 3.0 | (32) 0 | 0 | 0 | 0 | " | " | " | 0 |
| 3.5 | (40) 0 | " | " | " | " | " | " | 0 |
| 4.0 | (48) 0 | " | " | " | " | " | " | 0 |
| 4.5 | (56) 0 | 0 | 0 | 0 | 0 | 0 | 0 | (63) 0 |

FIG. 5

| ENGINE SPEED N / Tp | 0 | 800 | 1200 | 1600 | 2000 | 2400 | 2800 | 3200 |
|---|---|---|---|---|---|---|---|---|
| 0 | 0 | −0.1 | −0.1 | −0.1 | −0.1 | " | " | −0.1 |
| 1.5 | −0.1 | +0.1 | +0.1 | −0.1 | −0.1 | " | " | −0.1 |
| 2.0 | −0.1 | −0.1 | −0.1 | +0.1 | +0.1 | " | " | +0.1 |
| 2.5 | +0.1 | −0.1 | −0.1 | +0.1 | +0.1 | +0.1 | −0.1 | −0.1 |
| 3.0 | −0.1 | −0.1 | −0.1 | −0.1 | " | " | " | −0.1 |
| 3.5 | −0.1 | " | " | " | " | " | " | −0.1 |
| 4.0 | −0.1 | " | " | " | " | " | " | −0.1 |
| 4.5 | −0.1 | −0.1 | −0.1 | −0.1 | −0.1 | −0.1 | −0.1 | −0.1 |

FIG. 6

| ENGINE SPEED N / Tp | 0 | 800 | 1200 | 1600 | 2000 | 2400 | 2800 | 3200 |
|---|---|---|---|---|---|---|---|---|
| 0 | (0) 0 | (1) −0.1 | (2) 0 | (3) 0 | (4) " | (5) " | (6) " | (7) 0 |
| 1.5 | (8) 0 | (A) +0.1 | +0.001 | −0.1 | 0 | " | " | 0 |
| 2.0 | (16) 0 | 0 | (B) +0.001 | (C) +0.1 | 0 | " | " | 0 |
| 2.5 | (24) 0 | −0.1 | +0.001 | +0.001 | +0.001 | 0 | −0.1 | 0 |
| 3.0 | (32) 0 | 0 | +0.001 | +0.001 | 0 | " | " | 0 |
| 3.5 | (40) | " | " | " | " | " | " | 0 |
| 4.0 | (48) | " | " | " | " | " | " | 0 |
| 4.5 | (56) 0 | 0 | 0 | 0 | 0 | 0 | 0 | (63) 0 |

FIG. 7

| ENGINE SPEED N / Tp | 0 | 800 | 1200 | 1600 | 2000 | 2400 | 2800 | 3200 |
|---|---|---|---|---|---|---|---|---|
| 0 | 0 | −0.1 | −0.1 | −0.1 | −0.1 | " | " | −0.1 |
| 1.5 | −0.1 | +0.1 | +0.001 | −0.1 | −0.1 | " | " | −0.1 |
| 2.0 | −0.1 | −0.1 | +0.001 | +0.1 | +0.1 | " | " | +0.1 |
| 2.5 | +0.1 | −0.1 | +0.001 | +0.001 | +0.001 | +0.001 | −0.1 | −0.1 |
| 3.0 | −0.1 | −0.1 | +0.001 | +0.001 | +0.001 | +0.001 | +0.001 | −0.1 |
| 3.5 | −0.1 | " | " | " | " | " | " | −0.1 |
| 4.0 | −0.1 | " | " | " | " | " | " | −0.1 |
| 4.5 | −0.1 | −0.1 | −0.1 | −0.1 | −0.1 | −0.1 | −0.1 | −0.1 |

ELECTRONIC CONTROL APPARATUS FOR INTERNAL COMBUSTION ENGINE

FIELD OF THE INVENTION

The present invention relates to a control apparatus for an automotive internal combustion engine and, more particularly, to an electronic control apparatus which is provided with a learning function which enables a control operation to be effected with optimal control parameters at all times.

BACKGROUND OF THE INVENTION

Feedback control has heretofore been employed for effecting the knocking control or the air-fuel ratio control in relation to an internal combustion engine. In order to improve the responsiveness in such feedback control, what is called 'learning control method' has attracted attention recently in which deviation data of a feedback control value from a reference value is stored in a section within a memory map which corresponds to the operating condition of the engine at the time when the feedback control is effected, and when the engine is brought into the same operating condition as the above, the stored data is employed to correct the control value, thereby quickly controlling the control value to an optimum value. The fundamental concept of the learning control method has been disclosed in, for example, "Method of Controlling Air-Fuel Ratio for Internal Combustion Engine", Japanese Patent Laid-Open No. 26,229/1982, laid open in Japan on Feb. 12, 1982.

In a system adopting this conventionally known learning control method, as will become clear from the description in relation to FIG. 2 which will be made hereinafter, deviation data corresponding to an engine operation region which appears only when the engine is in a transient state is maintained at a value which has been initially set, since rewriting of the deviation data within the memory map is not effected indefinitely, and therefore, such deviation data is not subjected to learning control. For this reason, as shown in FIG. 5 in the above-described prior art, when the feedback control shifts from an engine operation region section b in which the deviation data has already been written and stored to a section a in which the storage of the deviation data has not yet been completed, namely, a transient state section a in which deviation data has not yet been stored, or when the feedback control shifts from the section a to any one of sections $\alpha'_{AFS}$ to $\alpha_{AFS}$ in FIG. 5 in the prior art in which data has already been stored, the control coefficient $\alpha$ has a shifting delay and, until the delay has completely disappeared, the control is held in an inappropriate state. In such cases, the air-fuel ratio may undesirably diverge from the stoichiometric value, which fact involves adverse effects on the engine, such as the generation of knocking and deterioration of the emitting condition of the exhaust gas.

SUMMARY OF THE INVENTION

Accordingly, it is a primary object of the present invention to provide an engine controlling apparatus which allows control data to be stored in almost all the sections within the memory map in an engine control system adopting the learning control method, whereby it is possible to effect an appropriate control at all times.

To this end, according to the invention, in a system adopting the learning control method and including a memory which stores data for control, when the number of sections in the memory in which data has already been written reaches a predetermined value with respect to the total number of sections in the memory, data is written in the other sections in which no data has yet been written, this data already being stored in the adjacent sections in which the writing of data has been completed.

BRIEF DESCRIPTION OF THE DRAWINGS

FIGS. 4 and 5 are charts showing the concept of a memory map in accordance with one embodiment of the present invention; and FIGS. 6 and 7 are charts showing the concept of a memory map in accordance with another embodiment of the present invention.

DESCRIPTION OF THE PREFERRED EMBODIMENTS

Figure 1:
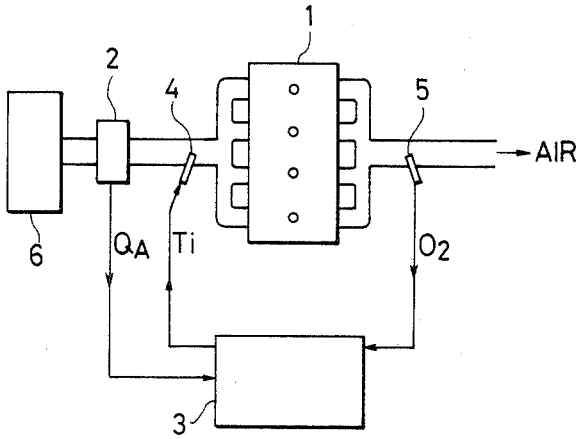
FIG. 1 is a block diagram of an engine control system adopting a learning control method to which the present invention is applied.

Referring first to FIG. 1, the air passing through an air cleaner 6 is further passed through an engine 1 and is dissipated into the atmosphere (air). In FIG. 1: the reference numeral 2 denotes an intake air flow sensor; 5 an $O_2$ sensor; 3 a control circuit; and 4 an injector (fuel injection valve).

The control circuit 3 includes a microcomputer and operates as follows. An intake air flow rate $Q_A$ in relation to the engine 1 is detected by the intake air flow sensor 2, and the output of the sensor 2 is input to the control circuit 3. The control circuit 3 determines a fuel injection amount in accordance with the detected intake air flow rate $Q_A$ and drives the injector 4 by a driving signal $P_i$, thereby supplying the engine 1 with a predetermined amount of fuel.

From the exhaust gas from the engine 1, the oxygen concentration in the air-fuel mixture is detected by the $O_2$ sensor 5, and a concentration signal $O_2$ is input to the control circuit 3. In accordance with the signal $0_2$, the control circuit 3 feedback-controls the driving of the injector 4 such that the air-fuel ratio of the air-fuel mixture sucked into the engine 1 is maintained in an optimum state. The pulse width $T_i$ of the driving signal $P_i$ in this case is determined by the following formula (1):

$$T_i=(K_1 \cdot Q_A/N \cdot K_2 \cdot \alpha)+T_s \quad (1)$$

where: $K_1$ represents a constant determined on the basis of, for example, the characteristics of the injector; $Q_A$ an intake air amount; N an engine speed; $K_2$ a correction coefficient determined on the basis of, for example, the engine temperature; $\alpha$ an air-fuel ratio control coefficient; and $T_s$ a correction amount determined on the basis of the battery voltage.

Figure 2:
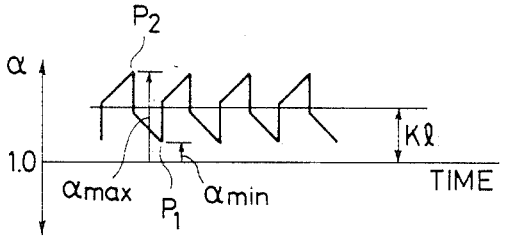
FIG. 2 is a time chart for a feedback control operation in an ordinary air-fuel ratio control system.

The feedback control by the signal $O_2$ from the $O_2$ sensor 5 is effected by varying the control coefficient $\alpha$ in the manner shown in FIG. 2. More specifically, the fuel supply amount is controlled by varying the control coefficient $\alpha$ such that the signal $O_2$ periodically represents a richer state (a state wherein the air-fuel ratio is richer than the stoichiometric value) and a leaner state (a state wherein the air-fuel ratio is leaner than the stoichiometric value), whereby a mean value of air-fuel ratios converges in proximity to the stoichiometric value (about 14.7). Under ideal conditions wherein the air-fuel ratio which is employed as a base of the control is in a correct state, the value of the control coefficient $\alpha$ fluctuates around 1.0 and, therefore, a mean value of air-fuel ratios is coincident with the stoichiometric value.

When the air-fuel ratio has deviated from the stoichiometric value for some reason, the center value of the control coefficient $\alpha$ is shifted by the $O_2$ feedback control in the direction in which the deviating air-fuel ratio may be corrected. For example, if the air-fuel ratio has become 10% richer, in order to correct the deviating air-fuel ratio, the control coefficient $\alpha$ is made to fluctuate around 0.9; when the air-fuel ratio has become 10% leaner, the control coefficient $\alpha$ is made to fluctuate around 1.1. As a result, a mean value of air-fuel ratios is allowed to coincide with the stoichiometric value again, thus accomplishing air-fuel ratio feedback control.

Incidentally, the above-described deviation of the air-fuel ratio from the stoichiometric value often occurs as the result of a change in the engine operating condition. In consequence, the above-described $O_2$ feedback control involves the fact that, as the engine operating condition changes, the control coefficient $\alpha$ also changes: when the engine operating condition is in a certain region, the control coefficient $\alpha$ fluctuates around 1.1; when the engine operating condition is in another region, the control coefficient $\alpha$ fluctuates around 0.9.

Thus, the above-described feedback control unavoidably involves a control delay. For this reason, even in the case where the engine operating condition has shifted from one region to another region and consequently the air-fuel ratio has deviated from the stoichiometric value, feedback control which is initiated in order to correct the deviating air-fuel ratio takes some time to complete the correction: from the time when the control coefficient $\alpha$ shifts from a value corresponding to one region to a value corresponding to a new region to the time when the deviating air-fuel ratio is properly controlled such as to converge in proximity to the stoichiometric value. During this control delay, the engine is disadvantageously running in a state wherein the air-fuel ratio is not coincident with the stoichiometrical value.

In order to eliminate such disadvantage, the following method has been employed. The engine operating condition is divided into a multiplicity of sections in accordance with, for example, the magnitude of the load and the engine speed. A deviation of the control coefficient $\alpha$ from a reference value ($\alpha=1.0$) in each section is obtained and is stored in a non-volatile memory. Then, every time the engine operating condition enters the same section, the feedback control is effected by employing the deviation value corresponding to that section, whereby control can be effected under a state wherein the control coefficient $\alpha$ fluctuates around 1.0 at all times.

The pulse width $T_i$ of the driving signal $P_i$ to be applied to the injector 4 is determined by the following formula (2):

$$T_i=\{K1\cdot Q_A/N\cdot K_2\cdot\alpha\cdot(1.0-K_l)\}+T_s \quad (2)$$

where K represents a deviation value of the control coefficient $\alpha$ from the reference value 1.0. The deviation value $K_l$ is given by the following formula (3):

$$K_l=\alpha-1.0 \quad (3)$$

Further, in this engine control system adopting the learning control method, the above-described deviation data $K_l$ are successively written into the sections within the map constituted by a non-volatile memory, such as a power supply backup RAM, by learning during an engine operation, or the written data $K_l$ are rewritten in order to effect correction.

According to this learning control method, it is not necessary to make preparations for the deviation data $K_l$ which are independent of each other by writing them into respective sections in the memory. Further, if there is a change in the characteristics of the engine and various actuators for control, the deviation data $K_l$ make self-correction in accordance with such change. It is, therefore, possible to effect correct control at all times and to maintain the engine in a correctly controlled state even when the engine operation is in a transient state.

However, a predetermined condition is imposed on the writing of the deviation data in the conventional learning control method. More specifically, the writing of the deviation data is executed only when an engine operation condition is maintained in the same section within the memory map for a period of time which is longer than a predetermined value and consequently it is possible to obtain deviation data which is measured in a state wherein the engine operation is sufficiently stable. This condition is a requisite for effecting a proper control by correct data and, therefore, it is almost impossible to remove the above-described condition.

Accordingly, in the system adopting the conventional learning control method, deviation data in the memory map which respectively correspond to engine operation regions which hardly or only transiently appear in the actual engine operation are not rewritten indefinitely, and the initially set data are maintained as they are.

An electronic control apparatus for an internal combustion engine according to the present invention will be described hereinunder in detail through embodiments with reference to the accompanying drawings.

The arrangement of an essential part of one embodiment of the present invention is the same as that of the system adpopting the conventional learning control method shown in FIG. 1. The embodiment differs from the conventional system in that the process shown in the flow charts of FIGS. 3A, 3B is executed by the microcomputer incorporated in the control circuit 3.

Figure 3A:
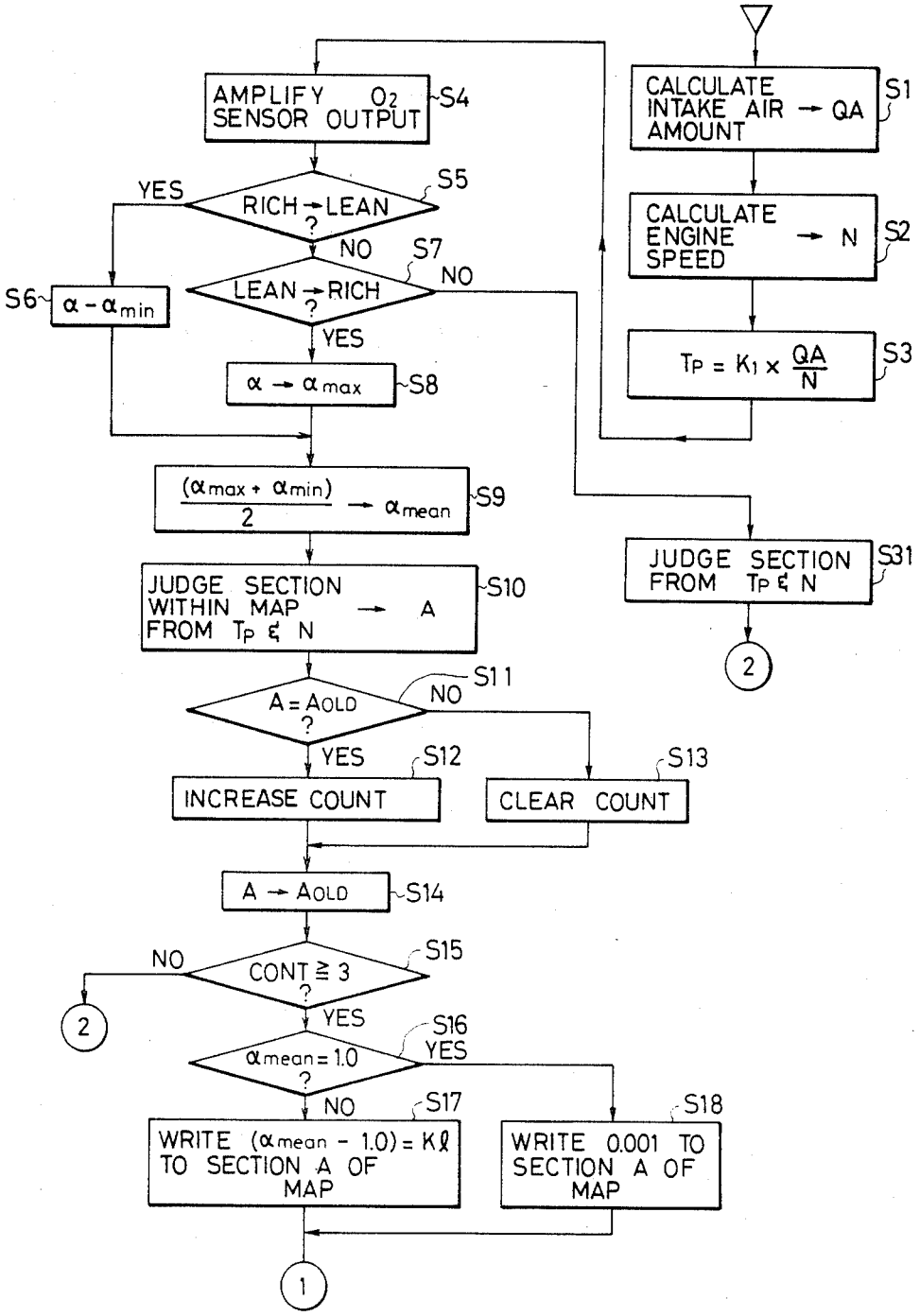
FIGS. 3A and 3B are flow charts for the operation of an electronic control apparatus for an internal combustion engine according to the present invention.
Figure 3B:
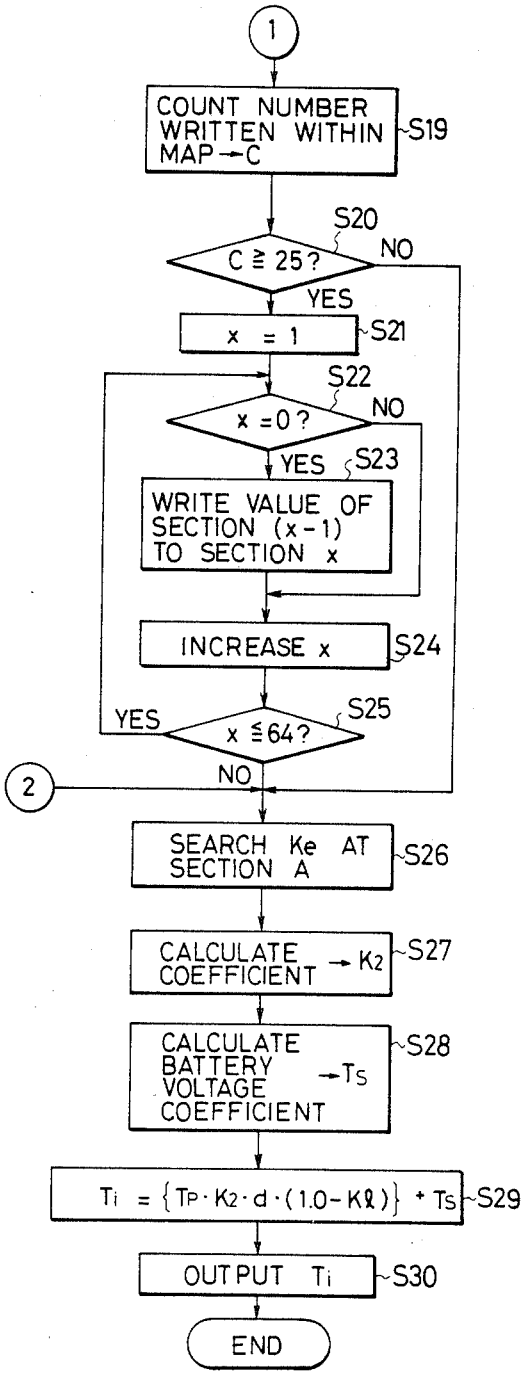

The process according to the flow charts shown in FIGS. 3A, 3B is periodically executed at a frequency which is suitable for properly effecting the control operation in relation to the injector 4. When this process is initiated, first of all, an engine intake air amount $Q_A$ and the engine speed N are successively calculated in a step S1 (hereinafter, "step" will be omitted and only the reference symbols will be shown, for example, "S1, S2 . . . ") and S2. Then, in S3, data $T_P$ is calculated from the data $Q_A$ and N. It is to be noted that the data $T_P$ is employed as a parameter for dividing the engine operation condition into sections.

In S4, a signal $O_2$ from the $O_2$ sensor 5 is input to the control circuit 3. The signal $O_2$ is successively examined in subsequent S5, S7. In S5, a judgement is made as to whether or not the signal $O_2$ has changed from a richer state to a leaner state, that is, whether or not the control coefficient $\alpha$ is at the point $P_1$ in FIG. 2. If the result of judgement is YES, the process proceeds to S6, in which the value of the control coefficient $\alpha$ is stored as $\alpha_{min}$, and the process proceeds to S9. If the result of judgement in S5 is NO, the process proceeds to S7, in which a judgement is made as to whether or not the signal $O_2$ has changed from a leaner state to a richer state, that is, whether or not the control coefficient $\alpha$ is at the point $P_2$ in FIG. 2. If the result of judgement is YES, the process proceeds to S8, in which the value of the control coefficient $\alpha$ is stored, and then the process proceeds to S9. If the results of the judgements made in S5 and S7 are both NO, that is, if the value of the control coefficient $\alpha$ is judged to be between the maximum value $\alpha_{max}$ and the minimum value $\alpha_{min}$ shown in FIG. 2, the process proceeds to S31 and further to steps infra S26, that is, as far as S30 in FIG. 3B, whereby ordinary calculation of the signal $T_i$ which is to be applied to the injector 4 is executed, and the process according to this flow chart is ended.

If the result of judgement made in either S5 or S7 is YES and consequently the process proceeds to S9, a mean value $\alpha_{mean}$ is calculated in S9. Then, in S10, a judgement is made from the data $T_p$ and N as to which section corresponds to the present operating condition of the engine. Let us assume that the section being judged is A.

In S11, a comparison is made between the number of the section A judged in S10 and the number $A_{OLD}$ of the section A which was judged during the processing step S10 which immediately precedes the present processing and has been stored during the processing of S14 (described later). If both are coincident with each other, the process proceeds to S12, in which a counter, which is associated with the control circuit 3, is incremented by one. If the above-described numbers are not coincident with each other, the process proceeds to S13, in which the counter is cleared.

Thereafter, the process proceeds to S14, in which the data A replaces the data $A_{OLD}$, and then the process proceeds to S15, in which the count of the above-described counter is examined. More specifically, as will beome clear from the description made hereinafter, a judgement is made as to whether or not the count is 3 or larger. As long as the result of judgement in S15 is NO, the process proceeds to S26, from which the process proceeds to S30 through S27, S28, S29.

On the other hand, if the result of judgement in S15 becomes YES, according to a first embodiment of the present invention, the process jumps to S17, in which data $K_l$ is obtained from the data $\alpha_{mean}$ which has been calculated in S9 and is written in the section A within a non-volatile memory such as a power supply backup RAM.

The following is explanation of the meaning of the fact that the result of judgement in S15 has become YES.

The result of judgement in S15 becomes YES when at least three consecutive YES's are judged in S11. This means that, while the engine operating condition is in the same section within the map, the processing which took place up to S11 has been executed at least three times consecutively.

On the other hand, the processing is carried out up to S11 when the result of judgement in either S5 or S7 is YES, that is, when the control of the engine by the control coefficient $\alpha$ is effected exactly at either the point $P_1$ or $P_2$ in FIG. 2.

Accordingly, the fact that the result of judgement in S15 has become YES means that, with the engine operating condition staying in the same section within the map, the feedback control of the engine by the fluctuation of the control coefficient $\alpha$ shown in FIG. 2 has been effected at least three times consecutively.

Since the processing of S17 is executed when the result of judgement in S15 has become YES, it will be understood that, in this embodiment, the condition of writing of data according to the learning control method is satisfied by the fact that, with the engine maintained in the same operating condition region, the feedback control of the engine by the fluctuation of the control coefficient $\alpha$ shown in FIG. 2 has been effected at least three times consecutively. It is to be noted that it may, as desired, be determined on which occasion this writing condition is satisfied, according to need.

When the processing of S17 has been finished, the process proceeds to S19, in which the number of sections in which writing of data has been executed by the processing of S17 is examined with respect to all the sections within the memory map. Let us assume that the number of such sections is C. It is to be noted that, to obtain the number C, a method may be employed in which "0" has been written in all the sections within the memory map before the operation of the system is started, and in the processing of S19, the values of all the sections within the map are successively read out, and the number of the sections from which "0" is not read out is counted and determined to be the number C. Another method of obtaining the number C may be one in which a specific memory region prepared in the non-volatile memory is employed to constitute a soft counter, and the soft counter is incremented every time the processing of S17 is executed, and the data contained in the counter is examined in S19, thereby obtaining the number C.

After the number C has been obtained, the number C is compared with a predetermined number, e.g., 25, in a subsequent S20, thereby making a judgement as to whether or not the number C is 25 or larger. As long as the result of judgement in S20 is NO, the process proceeds to the steps infra S26 while skipping over the processing of S21 to S25.

On the other hand, if the result of judgement in S20 is YES, that is, if it is judged that writing of data by learning has been carried out with respect to 25 sections from among all the sections within the memory map, the process first of all proceeds to S21, in which the section number x is set to 1.

FIG. 4 shows an example of the memory map in accordance with this embodiment.

The memory map shown in FIG. 4 is divided into eight sections in each of the row and column directions, thereby providing a total of 64 sections. In this case, the memory map is divided in the row direction by the variable $T_p$ which represents an engine load, and the memory map is divided in the column direction by the engine speed N. Further, the section number x is consecutively given to the sections from the first row, from the left-hand side toward the right-hand side (as viewed in FIG. 4), such that the section defined by the first row and the first column has the number 0 and the section defined by the eighth row and the eighth column has the number 63. It is to be noted that the section number x is shown in parentheses in a part within each section.

In S22, data is read out from a section in the memory map which has the number x, and a judgement is made as to whether or not the value of the section is "0". As long as the result of judgement is NO, the subsequent S23 is skipped over. Only when the result of judgement in S22 is YES, is the processing of S23 executed in such a manner that data is read out from a section within the map having a section number (x-1) and is written into the section with the number x.

In S24, the section number x is incremented by one. In other words, a processing is executed in which the number x is consecutively increased by one. In a subsequent S25, the incremented section number x is examined, and a judgement is made as to whether or not the section number x is 63 or smaller, the number 63 representing the total number of sections within the memory map. As long as the result of judgement is YES, the process returns to S22, and the processing of S22 to S24 is repeated.

As a result, when writing of data obtained by learning control has been completed with respect to the sections the number of which coincides with a predetermined proportion of the total number of sections within the memory map, namely, 25 sections in a total of 64 sections, writing of data is executed with respect to the other sections into which no data has been written on the basis of the data in the sections into which data has already been written. In consequence, as shown in FIG. 5, data which is approximate to the result of learning is written into almost all the sections within the memory map.

The processing carried out in the steps from S26 to S30 is necessary for the control of the injector 4. First of all, in S26, data $K_l$ is read out from the section A within the memory map. The section A in this case has been judged in either S10 or S31 and represents the region of the present engine operating condition. In the subsequent S27 and S28, the coefficients $K_2$, $T_s$ are successively calculated. Thereafter, the process proceeds to S29, in which data $T_i$ representing a pulse width which is required for the driving signal $P_i$ which is to be applied to the injector 4 is calculated from the control coefficient $\alpha$, the data $K_l$, the variable $T_p$, etc. The data $T_i$ is set in a predetermined injector controlling register by the processing of S30, thus ending the process according to the flow chart shown in FIGS. 3A and 3B.

According to this embodiment, therefore, it is possible to control the injector 4 with excellent responsiveness by the learning control method. Further, according to this embodiment, when the number of sections into which data has already been written reaches a predetermined value with respect to the total number of sections within the memory map, approximate data is written into almost all the sections into which no data has been written. It is, therefore, possible to effectively eliminate the air-fuel ratio control delay due to the existence of sections in which writing of data has not yet been completed, thereby satisfactorily preventing deterioration of the emitting condition of the exhaust gas.

Incidentally, according to the above-described embodiment, the number of sections within the memory map, namely, the number of sections corresponding to engine operating condition regions for effecting feedback control, is set at 64. Moreover, when the number of sections into which learning control data has already been written reaches 25, data which is approximate to the learning control data is written into the other sections in the memory map. However, the total number of the sections is not necessarily limited to 64 and may be set as desired. Further, the above-described number 25 of the sections may, as a matter of course, be set as desired.

Moreover, the method of writing the approximate data employed in the above-described embodiment is as follows: By the processing of S20 to S25, approximate data which is to be written into each of the sections in which writing of data has not yet been completed is selected to be the data in the section which is both one into which learning control data has already been written and is also the first section to be found when tracing backwardly through the sections, that is, from a given section to the preceding section whose number is one smaller than that of the former. However, the above-described method is not necessarily limitative and the present invention can be carried out in various forms. For example, with respect to sections in which writing of data has not yet been completed and which are between two sections into which learning control data has already been written, data may be written which is a mean value of the data contained in these two sections. Further, such mean value may be obtained by averaging the data contained in two sections adjacent to each other in the column direction and the data contained in two sections adjacent to each other in the row direction.

It is to be noted that, although, in the above-described embodiment, the present invention is applied to the air-fuel ratio control system, the invention is not limited in relation to air-fuel ratio control systems and is, as a matter of course, applicable to any systems which adopt a learning control method. For example, the invention may be applied to a knocking control system.

As described above, the first embodiment of the present invention is arranged such that, in an engine control system adopting a learning control method, when the number of sections in which data has already been written reaches a predetermined value with respect to the total number of sections within a memory which stores data for control, data is forcedly written into each of the other sections into which no data has been written, this data already being stored in nearby section in which writing of data has already been completed, whereby almost all the sections within the memory map are allowed to have data stored therein, thereby overcoming the disadvantages of the prior art and enabling an appropriate control to be effected at all times.

According to the first embodiment, however, when deviation data which is obtained as the result of the above-described feedback control is very small so that it does not reach a predetermined value, it is judged that there is no deviation of the feedback control value from the reference value, and in such cases, writing of data is not executed with respect to the memory map section concerned.

In consequence, if writing of data is forcedly executed with respect to sections in which no data has been written when the number of sections into which data has already been written reaches a predetermined value with respect to the total number of sections within the memory map, data which represents an improper value may be written into even a section within the memory map into which data has already been written since the deviation data therein is zero. In such cases, it is not possible to accomplish correct control.

A second embodiment of the present invention which will be described hereinunder is arranged such as to overcome the above-described disadvantage of the first embodiment of the invention. The fundamental arrangement of the second embodiment is the same as that of the first embodiment, as will be clear from the following description.

According to the second embodiment of the present invention, there is provided an engine control apparatus which is free from the possibility of incorrect control even when forced writing of data is executed with respect to all the sections within the memory map into which no data has been written and which apparatus is consequently able to effect excellent control at all times.

According to the second embodiment of the present invention, with respect to a section within the memory map in which, although the condition of writing deviation data is satisfied as the result of feedback control, the deviation of the feedback control value from the reference value is so small that it can be regarded as zero and it is, consequently, judged that writing of deviation data should not be executed therein, data is written which represents a value determined on the basis of a minimum resolving power by which data can be written into the memory map so that the written data represents the fact that the section is one in which writing of data has already been completed, whereby data representing an improper value is prevented from being written by the forced writing of data.

Similarly to the case in the first embodiment, in the second embodiment of the present invention also, the arrangement of its essential part is the same as that of the system adopting the conventional learning control method shown in FIG. 1. According to the second embodiment, the process shown in the flow charts of FIGS. 3A and 3B is executed by the microcomputer incorporated in the control circuit 3.

The difference between the first and second embodiments of the present invention will be described hereinunder with reference to FIGS. 3A and 3B.

The second embodiment differs from the first embodiment in that the second embodiment includes steps S16 and S18 in the process shown in FIGS. 3A and 3B.

According to the second embodiment, when the result of judgement in S15 shown in FIG. 3A becomes YES, the process proceeds to S16, in which a judgement is made as to whether or not the data $\alpha_{mean}$ calculated in S9 is 1. If the result of judgement is NO, the process proceeds to S17, in which data $K_l$ is calculated from the data $\alpha_{mean}$ calculated in S9 and is written into a section A, for example, within the map constituted by a non-volatile memory such as a power supply backup RAM.

On the other hand, if the result of judgement in S16 is YES, the processing of S18 is executed, whereby a minimum data value which can be stored in this memory, which is 0.001 in this embodiment, is written into the section A within the memory map.

When the processing of either S17 or S18 has been finished, the process proceeds to S19 in FIG. 3B, in which the number of sections in which writing of data has been executed by the processing of either S17 or S18 is examined with respect to all the sections within the memory map. Let us assume that the number of such sections is C. It is to be noted that, to obtain the number C, a method may be employed in which "0" has been written in all the sections within the memory map before the operation of the system is started, and in the processing of S19, the values of all the sections within the map are successively read out, and the number of the sections from which "0" is not read out is counted and determined to be the number C. Another method of obtaining the number C may be one in which a specific memory region prepared in the non-volatile memory is employed to constitute a soft counter, and the soft counter is incremented every time the processing of either S17 or S18 is executed, and the data contained in the counter is examined in S19, thereby obtaining the number C.

After the number C has been obtained, the number C is compared with a predetermined number, e.g., 25, in the subsequent S20, thereby making a judgement as to whether or not the number C is 25 or larger. As long as the result of judgement in S20 is NO, the process proceeds to the steps infra S26 while skipping over the processing of S21 to S25. The processing taking place thereafter is the same as that in the case of the first embodiment of the present invention.

FIG. 6 shows an example of the memory map in accordance with the second embodiment.

The memory map shown in FIG. 6 is divided into eight sections in each of the row and column directions, thereby providing a total of 64 sections. In this case, the memory map is divided in the row direction by the variable $T_p$ which represents an engine load, and the memory map is divided in the column direction by the engine speed N. Further, the section number x is consecutively given to the sections from the first row, from the left-hand side toward the right-hand side (as viewed in FIG. 6), such that the section defined by the first row and the first column has the number 0 and the section defined by the eighth row and the eighth column has the number 63. It is to be noted that the section number x is shown in parentheses in a part within each section.

In S22, data is read out from a section in the memory map which has the number x, and a judgement is made as to whether or not the value of the section is "0". As long as the result of judgement is NO, the sebsequent S23 is skipped over. Only when the result of judgement in S22 is YES, is the processing of S23 executed in such a manner that data is read out from a section within the map having a section number (x−1) and is written into the section with the number x. In S24, the section number x is incremented by one. In other words, a processing is executed in which the number x is consecutively increased by one. In the sebsequent S25, the incremented section number x is examined, and a judgement is made as to whether or not the section number x is 63 or smaller, the number 63 representing the total number of sections within the memory map. As long as the result of judgement is YES, the process returns to S22, and the processing of S22 to S24 is repeated.

As a result, when writing of data obtained by learning control has been completed with respect to the sections the number of which coincides with a predetermined proportion of the total number of sections within the memory map, namely, 25 sections in a total of 64 sections, writing of data is executed with respect to the other sections into which no data has been written on the basis of the data in the sections in which writing of data has already been completed. In consequence, as shown in FIG. 7, data which is approximate to the result of learning is written into almost all the sections within the memory map.

According to the second embodiment, therefore, it is possible to control the injector 4 with excellent responsiveness by the learning control method. Further, according to this embodiment, when the number of sections into which data has already been written reaches a predetermined value with respect to the total number of sections within the memory map, approximate data is written into almost all the sections into which no data has been written. Moreover, in this case, with respect to a section into which data "0" should have been written, a numerical value is written which is sufficiently large for representing the fact that writing of data in that section has already been completed and which is, at the same time, a very small value that can be regarded as zero from the viewpoint of control, for example, 0.001. Therefore, there is no possiblity that an improper numerical value may be written into such section. Thus, it is possible to effectively eliminate the air-fuel ratio control delay due to the existence of sections in which writing of data has not yet been completed and to obtain high accuracy in control. Accordingly, it is possible to satisfactorily prevent deterioration of the emitting condition of the exhaust gas.

The following is a description of the difference between the map in which writing of data has been completed in accordance with the second embodiment and the map in which writing of data has been completed in accordance with the first embodiment.

Let us make a comparison between the contents of both the maps at the time when the number of sections in which writing of data has been completed reaches a predetermined value, for example, 25, and consequently the above-described writing operation is to be started, that is, when the result of judgement in S20 shown in FIG. 3B is YES, the contents of the map in accordance with the second embodiment are such as those shown in FIG. 6, whereas the contents of the map in accordance with the first embodiment are such as those shown in FIG. 4.

More specifically, among the sections shown in FIGS. 6 and 4, the sections which are respectively defined by the column representing an engine speed $N=1{,}200$ and the rows respectively representing variables $T_p=1.5, 2.0, 2.5, 3.0$ and the section defined by the column representing an engine speed $N=2{,}000$ and the row representing a variable $T_p=2.5$ are ones which have been judged as the result of feedback control that their devitation data should remain zero. In consequence, according to the second embodiment shown in FIG. 6, into these sections is written 0.001 which is a minimum numerical value which can be written into the memory, the value representing the fact that it is no longer necessary to forcedly write any data into the sections.

On the other hand, in the map in accordance with the first embodiment shown in FIG. 4, the above-described sections and the sections with respect to which calculation of deviation data by feedback control has not been carried out equally remain zero.

As a result, the contents of the map after forced writing has been executed become such as those shown in FIG. 7 in accordance with the second embodiment. Thus, data which can be regarded as zero from the viewpoint of control is written into the sections which should have been zero and still would have allowed correct control and the sections subsequent thereto, whereby there is no possibility that improper data may be forcedly written into those sections.

As has been described above, according to the present invention, it is possible to minimize the number of sections in which writing of data has not been completed within the memory map in the engine control system adopting the learning control method. Thus, the disadvantages of the prior art can be overcome, and it is possible to readily provide an electronic control apparatus for an internal combustion engine which is able to satisfactorily compensate for a feedback control delay at all times and to satisfactorily effect an appropriate control even when the engine is in a transient state, thereby making it possible to maintain the emitting condition of the exhaust gas in an excellent state at all times.

What we claim is:

1. In a control apparatus for an internal combustion engine of the type in which a deviation value of a feedback control value from a reference value for each of predetermine engine operating condition sections of said engine is stored in a region in a memory in the form of a map and is read out in order to be used as a correction value when control is effected in relation to the corresponding predetermined engine operating condition section, an electronic control apparatus for an internal combustion engine comprising an operating arrangement wherein the number of regions in said memory into which deviation values for said operating condition sections have already been written are examined, and when said number of regions reaches a predetermined value, a deviation value is written into each of the said regions in said memory into which no deviation values have yet been written, said deviation value already being stored in the adjacent region in which writing of said deviation data has been completed.

2. An electronic control apparatus for an internal combustion engine according to claim 1, wherein, when said deviation value for any one of said operating condition sections is zero, a minimum value which is determined on the basis of a minimum resolving power by which deviation data can be written into said memory is written into a predetermined region in said memory which corresponds to the operating condition section.

* * * * *